US009812229B2

(12) United States Patent
Paschal et al.

(10) Patent No.: US 9,812,229 B2
(45) Date of Patent: Nov. 7, 2017

(54) SAFE GEOMETRY VACUUM DESIGN

(71) Applicants: Lane Scott Paschal, Loudon, TN (US); Clinton Eugene Gross, Paducah, KY (US)

(72) Inventors: Lane Scott Paschal, Loudon, TN (US); Clinton Eugene Gross, Paducah, KY (US)

(73) Assignee: Paschal-Gross Enterprises, Inc., Loudon, TN (US)

( * ) Notice: Subject to any disclaimer, the term of this patent is extended or adjusted under 35 U.S.C. 154(b) by 402 days.

(21) Appl. No.: 14/636,231

(22) Filed: Mar. 3, 2015

(65) Prior Publication Data

US 2015/0255180 A1 Sep. 10, 2015

Related U.S. Application Data

(60) Provisional application No. 61/947,639, filed on Mar. 4, 2014.

(51) Int. Cl.
*G21F 9/00* (2006.01)

(52) U.S. Cl.
CPC ..... *G21F 9/001* (2013.01)

(58) Field of Classification Search
CPC ..... B01D 50/00; B01D 50/002; Y10S 55/09
(Continued)

(56) References Cited

U.S. PATENT DOCUMENTS 3,816,247 A * 6/1974 Cayol ..... G21C 3/324 376/434

3,816,248 A * 6/1974 Cayol ..... G21C 3/12 376/172

(Continued)

OTHER PUBLICATIONS

Tiger-Vac, Inc., 2D-9 NUC HEPA Dry Recovery brochure, http://www.tiger-vac.com, Accessed Mar. 5, 2014.

(Continued)

*Primary Examiner* — Duane Smith
*Assistant Examiner* — Minh-Chau Pham
(74) *Attorney, Agent, or Firm* — Luedeka Neely Group, P.C.

(57) ABSTRACT

A vacuum assembled along a centerline axis used to collect fissile material. The vacuum includes a housing having internal chamber, a top end having a top opening, a bottom end having a bottom opening, and a radial intake port opening. The vacuum includes a suction apparatus having an intake disposed at the intake opening and having a hose connection means for mating with a vacuum hose assembly. The suction apparatus also includes a flow-through fan disposed in the top opening. The fan intakes and exhausts the airflow in a direction parallel with the centerline axis. The suction apparatus also includes a container connection means disposed at the bottom opening for connecting an external container to bottom end of the housing. There is also provided a first cylindrical free space having a center point disposed along the centerline axis and a diameter passing through the center point. The diameter of the first cylindrical free space is less than or equal to the safe diameter for the fissile material of interest. The vacuum cleaner apparatus is sized to fit entirely within the diameter of the first free space. Therefore, the vacuum apparatus constitutes a single fissile unit that is safe by passive geometry control to prevent the potential for a nuclear criticality in the vacuum.

18 Claims, 12 Drawing Sheets

(58) Field of Classification Search
USPC ..... 55/337, 356, 429, 467, 482, 505, DIG. 9
See application file for complete search history.

(56) References Cited

U.S. PATENT DOCUMENTS

| | | | | | |
|---|---|---|---|---|---|
| 4,061,480 | A * | 12/1977 | Frye | B01D 46/0094 | 422/159 |
| 4,261,713 | A | 4/1981 | Bourdois et al. | | |
| 4,352,778 | A * | 10/1982 | Arnaud | G21C 3/322 | 376/203 |
| 4,695,299 | A | 9/1987 | Spadaro et al. | | |
| 5,273,561 | A * | 12/1993 | Zeren | A47L 7/0028 | 55/379 |
| 5,301,388 | A | 4/1994 | Zeren | | |
| 6,716,261 | B2 * | 4/2004 | Carroll | B01D 50/002 | 55/337 |
| 7,909,910 | B2 | 3/2011 | Benner | | |
| 2007/0133734 | A1 * | 6/2007 | Fawcett | G21C 1/303 | 376/438 |
| 2008/0253496 | A1 * | 10/2008 | McCarty | G21C 7/117 | 376/327 |
| 2008/0256744 | A1 | 10/2008 | Rowntreer et al. | | |
| 2009/0300872 | A1 * | 12/2009 | Griffith | A47L 9/1683 | 15/347 |
| 2015/0155060 | A1 * | 6/2015 | Yetisir | G21C 3/322 | 376/361 |

OTHER PUBLICATIONS

Carroll, M.K. et al., Review of Current Nuclear Vacuum Systems Technologies, WM'03 Conference, Feb. 23-27, 2003.

Inventure! Laboratories Inc., SafeVac Safe Nuclear & HazMat Vacuum Systems flyer, http://www.safevac.net.

* cited by examiner

SAFE GEOMETRY VACUUM DESIGN

FIELD

This invention relates to the field of vacuums and, more particularly, this invention relates to a vacuum having a geometry that is safe for use in connection with fissile materials.

SUMMARY OF THE INVENTION

In the description that follows, the term "fissile unit" will be used to refer to an item or assembly of items that could contain fissile material. The term fissile material will be used to refer to fissionable materials capable of undergoing nuclear fission with thermal neutrons (examples including $^{233}U$, $^{235}U$, and $^{239}Pu$). Fissile materials can support a nuclear chain reaction with neutrons of any energy (e.g. fast or thermal neutrons). The term criticality will be used to refer to an accidental nuclear fission chain reaction. The term moderation will refer to the presence of materials that slow neutrons to energies that increase the probability of nuclear fission.

It is known that if a sufficient amount of fissile material is collected in an unsafe geometry, there is a risk that a criticality could occur. A vacuum cleaner system that could potentially be used for the collection of fissile material should be designed to ensure that it would remain sub-critical regardless of the mass and degree of moderation of fissile material that has been collected.

There are a number of criticality parameters that impact this analysis. A first parameter is the size and shape of the vacuum itself constituting its geometry. If the geometry is properly limited then the assembly will remain sub-critical regardless of the mass and degree of moderation of fissile material that it might contain. In fact, fissile material confined within a cylinder of any length will remain sub-critical as a single unit if the maximum diameter is limited so that it does not exceed a safe diameter at any point along its axis. A fissile unit of any cross-sectional shape (for example square tubing) would remain subcritical if it remains within a safe diameter in free space along all directions perpendicular to the common axis under normal conditions and under upset conditions such as expansion or indention. The particular value that is considered a safe diameter depends on the fissile material of interest. For any fissile material, there exists a diameter below which criticality cannot be achieved regardless of the mass or degree of moderation of that material.

In addition to the geometry of the vacuum itself, another consideration in providing a safe vacuum for fissile material is to ensure that there is no possibility for an unsafe interaction between fissile material in the vacuum assembly and fissile material in external sources such as process equipment in the area where the vacuum is being stored, transported, or used. For example, two fissile units might have a safe geometrical shape when they are stored individually apart from one another at a safe distance. However, they could become unsafe when brought within an unsafe distance from one another such that neutronic coupling—neutrons from one fissile unit reaching fissile material in a second fissile unit—were to occur. This could occur, for example, when two individual vacuums are stored too closely to one another without sufficient spacing to prevent interaction between the vacuums. This might also occur with a single vacuum system if its configuration includes a suction apparatus that is separate from the storage container(s) for the fissile material. In that case, there is a chance that the fissile material in the vacuum could unsafely interact with the fissile material in the storage container(s). The probability of a criticality in that configuration is higher than in the proposed system which establishes passive safety by ensuring that all components in the vacuum system assembly are maintained within a single safe geometry in free space along a single common axis.

Prior art devices have attempted to provide a safe geometry vacuum, but these attempts have failed because the devices disclosed have failed to provide a vacuum that is truly safe geometry. Certain of these systems use large components, such as a large fan unit, to achieve the necessary vacuum pressure and efficiency required to remain useful. Because these large components are not limited to a safe geometry, the vacuum, as a whole, cannot be considered safe. Also, some systems provide safe geometry storage containers, but use a vacuum unit that is remote from the storage containers. As discussed above, this creates the possibility of unsafe interactions between the two separate fissile units and the vacuum safety basis would require more complex and higher risk controls than if it were a single-unit that is safe by passive geometry control.

Another disadvantage of prior art devices is the time and cost required to place the vacuum into service. Before any vacuum can be placed into service, an engineering analysis is typically conducted that considers each of the criticality parameters, including the two discussed above, to ensure that that particular vacuum will remain sub-critical in a particular environment. This analysis is very time consuming because models must be created to ensure the interaction between fissile units is safe. Often, the cost of the engineering analysis required to ensure that these devices remain sub-critical is substantially greater than the vacuum cleaner itself.

What is needed, therefore, is a vacuum system for use in connection with fissile materials that provides a system-wide safe geometry and that may be easily analyzed and quickly placed into service.

The above and other needs are met by an apparatus that includes a single unit elongate vacuum cleaner assembled along a centerline axis. The vacuum cleaner is configured for the separation and recovery of a fissile material entrained in an airflow. It includes a housing having an outer wall having an outer wall surface and an inner wall surface that defines an internal housing chamber. The housing also includes a top end having a top opening, a bottom end having a bottom opening, and a radial intake port opening located in the outer wall near the bottom end.

The vacuum also includes a removable suction apparatus. The suction apparatus includes an intake that is positioned in the intake port opening. The intake has a first extension portion extending from the intake port opening into the internal housing chamber that is configured to direct the airflow towards the bottom end of the vacuum housing. The intake also includes a second extension portion extending from the intake port opening outwards away from the vacuum housing. The second extension portion has a hose connection means for mating with a vacuum hose assembly.

The suction apparatus also includes a flow-through fan and fan housing. The fan is mounted near the top opening of the housing and has an intake opening and an exhaust opening. The fan is configured to intake and exhaust the airflow in a direction parallel with the centerline axis. The fan housing is configured to mount to the fan and has a diffuser assembly that includes a plurality of stationary angled vents that are arranged to cover at least a portion of the exhaust opening of the fan.

The suction apparatus also includes a fixed first filter support mounted within the internal housing chamber that is configured to support a bottom portion of a filter. Also, a removable second filter support is configured to support a top portion of a filter.

The suction apparatus also includes a first baffle having a bottom surface and a top surface joined at a baffle centerline. The first baffle is sized and configured to obstruct a first half of an airflow path through the internal housing chamber. The bottom surface of the first baffle is configured to redirect the airflow in a first direction towards the inner wall surface. A second baffle having a bottom surface and a top surface joined at a baffle centerline is also provided. The second baffle is sized and configured to obstruct a second half of an airflow path through the internal housing chamber. The bottom surface of the second baffle is configured to redirect the airflow in a second direction towards the inner wall surface.

A third baffle is configured to direct the airflow to the intake of the fan through a funnel action. The third baffle includes a lower sidewall portion having a bottom surface and one or more bottom airflow openings located in the bottom surface that extend through the lower portion. The third baffle further includes a middle sidewall that forms a cone region having a top opening and a hollow interior. The hollow interior is in flow communication with the one or more bottom airflow openings. Finally, the third baffle includes an upper sidewall that extends away from an external surface of the middle sidewall. A portion of the upper sidewall is configured to contact the inner wall surface of the housing.

The suction apparatus also includes connection means located near the bottom opening for connecting an external container to bottom end of the vacuum housing.

The apparatus also has a first cylindrical free space having a diameter that passes through the centerline axis. The vacuum cleaner apparatus is sized to fit entirely within the diameter of the free space, and the diameter of the first cylindrical free space is the maximum sub-critical diameter of a cylinder of the fissile material.

In certain embodiments, the apparatus also includes a spacer. The spacer includes a cage having an outer contact surface. In particular, the cage includes upper and lower spacing members disposed around the vacuum and spaced apart from one another, at least one first support member configured to connect the upper and lower spacing members together, and a second support member configured to connect the at least one first support member and the vacuum together. The spacer also includes a second cylindrical free space having a center point disposed along the centerline axis and a diameter passing through the center point. The diameter of the second cylindrical free space is the minimum safe distance between the vacuum cleaner and a second fissile unit external to the vacuum that is required to prevent a criticality from occurring between the vacuum and the second fissile unit. The cage shape may be a cylinder, square, or any cross-sectional shape so long as the cage is sized and configured so that the outer contact surface is located entirely outside of the second cylindrical free space.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
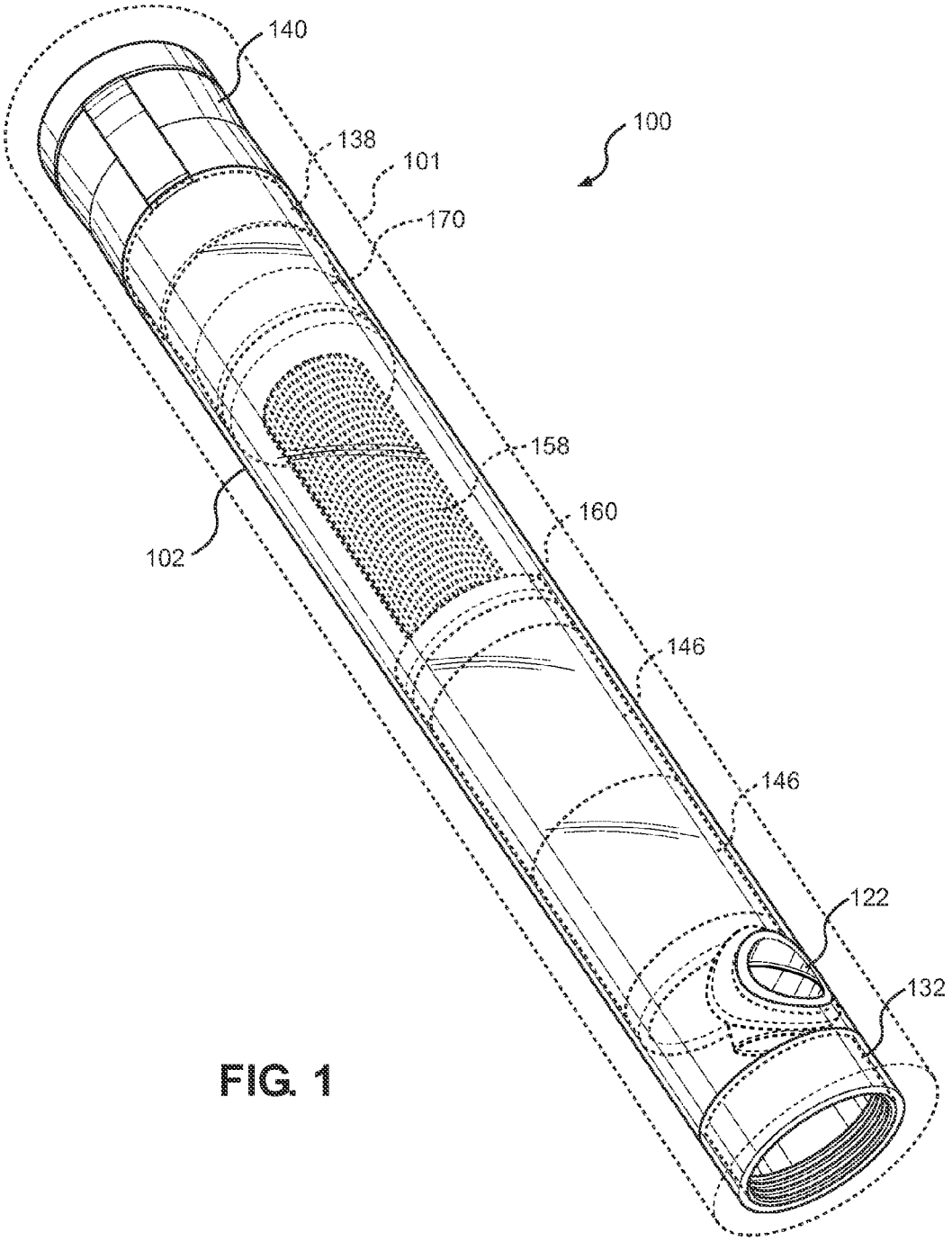
FIG. 1 is a perspective view of vacuum cleaner apparatus and a first cylindrical free space according to an embodiment of the present invention.
Figure 2:
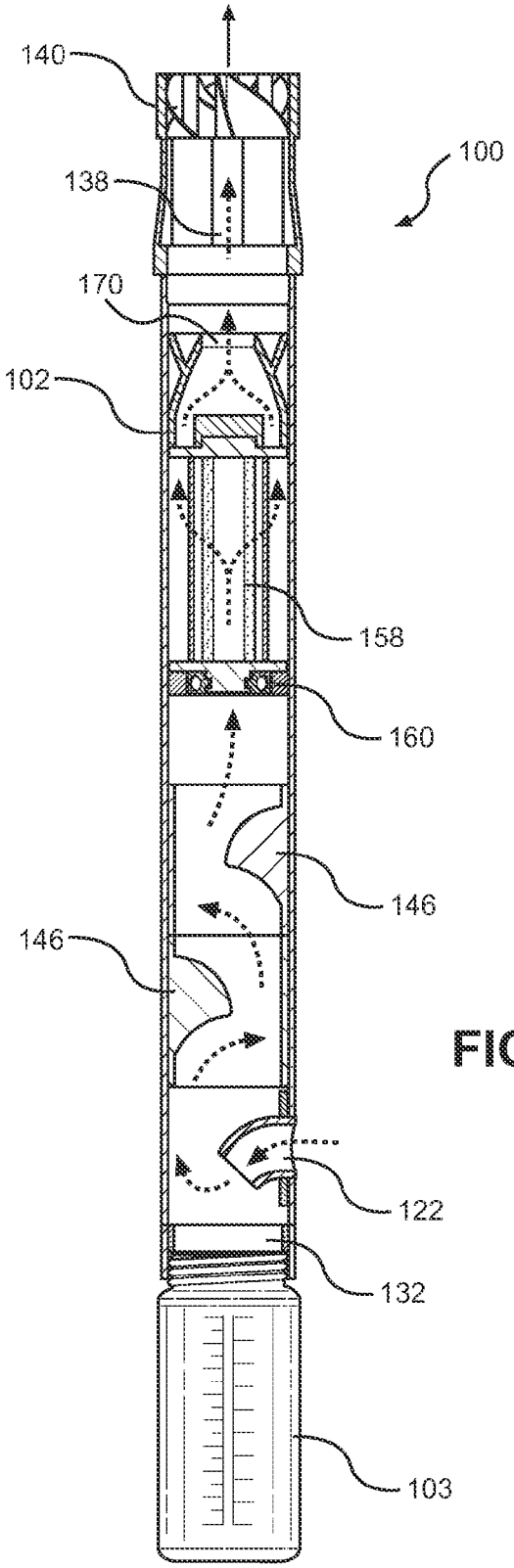
FIG. 2 is front view of the vacuum cleaner apparatus in FIG. 1 illustrating the airflow through an internal housing chamber, where a fan motor is not shown.
Figure 3:
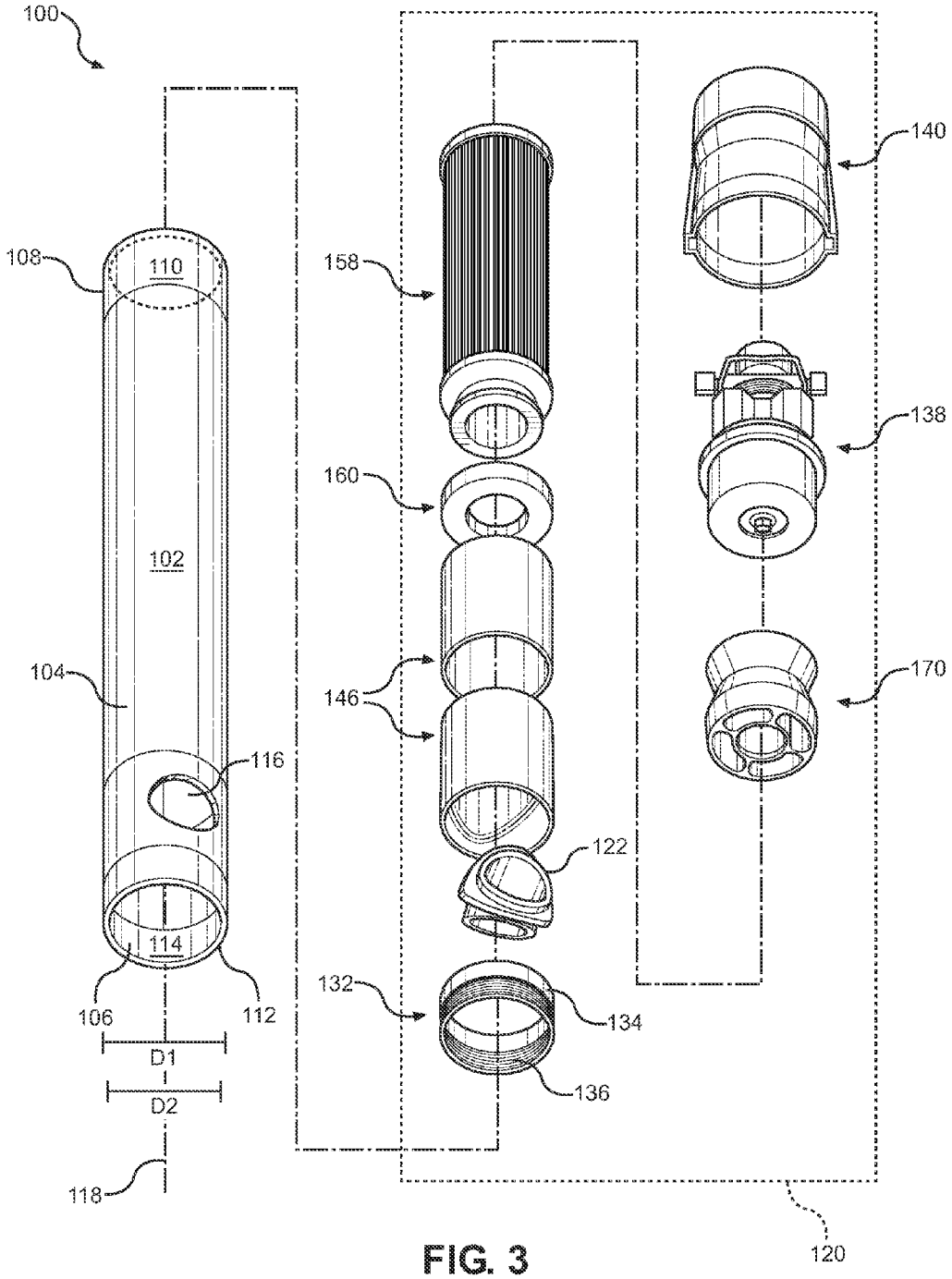
FIG. 3 is an exploded view of the vacuum cleaner apparatus in FIG. 1.

Referring now to the drawings in which like reference characters to designate like or corresponding parts throughout the several views, there is shown in FIGS. 1-3 a vacuum cleaner apparatus 100 for the separation and recovery of solid or liquid product transported by an airflow according to an embodiment of the present invention.

Specifically, the apparatus is intended for the removal of materials, such as dust and debris, which contain fissile material such as $^{235}U$ or $^{239}Pu$. As discussed in greater detail below, this apparatus was designed with specific components that would enable all components to fit within a safe or favorable geometrical configuration that minimizes or, more preferably, eliminates entirely the risk that the fissile material unit might cause a nuclear criticality.

In general, the present invention provides a vacuum apparatus 100 wherein all vacuum components discussed below are maintained on a single axis within a first cylindrical free space 101. The maximum diameter of that free space 101 is less than the minimum diameter required for a criticality to occur within a fissile unit for a given environment and the fissile material involved. The size of the free space 101 will change depending on the environment in which the vacuum apparatus 100 is used and the fissile material involved. The ANSI/ANS-8.1-1998 standard provides the subcritical limits for fissile material having various compositions in a variety of configurations. For example, as shown in Table 1, an infinite cylinder of fissile material that includes $^{235}UO_2F_2$ will remain sub-critical if the diameter of the cylinder is 13.7 cm or less. As such, the free space 101 used in that particular environment would be equal to or less than 13.7 cm (5.3937 in) in order to ensure that the fissile unit remains sub-critical. In other environments, where different fissile materials are present, the size of the free space would be smaller or larger, depending on the fissile materials present in that environment. For example, an infinite cylinder of $^{239}$Pu-metal would remain subcritical if the diameter was less than 4.4 cm.

The apparatus 100 includes a housing 102 that is defined by an outer wall surface 104 having an outer diameter D1 and an inner wall surface 106 having an inner diameter D2 and defining an internal housing chamber. Since the outer diameter D1 and the inner diameter D2 are within the free space 101, the internal housing chamber is sized and configured to passively prevent an unsafe geometry.

Preferably, the wall thickness (i.e., the distance between outer and inner wall surface 104, 106) is sufficient to prevent the housing 102 from bulging or bending under the vacuum load or due to external forces such as impacts caused by an operator. This type of bulging or bend could potentially increase the internal geometry and allow for an unsafe geometry to occur. The precise wall thickness required to prevent bulging or bending of the housing 102 depends on a number of factors, including the material used for the housing as well as the type of fan used. However, the wall thickness should be sized to minimize deformation of the housing 102 caused by impacts to the vacuum during normal use.

The vacuum housing 102 further includes a top end 108 having a top opening 110 a bottom end 112 having a bottom opening 114. An intake port opening 116 is located in the outer wall near the bottom end 112. A centerline axis 118 extends between the bottom end 112 and the top end 108. The housing 102 may be constructed from a metal or metal alloy, such as ASTM 304 stainless steel or ASTM 6061 aluminum. However, the housing may be constructed from different metals, metal alloys, or non-metals, depending on the customer's needs and budget.

A suction apparatus 120 is positioned entirely along the centerline axis 118 and is substantially within the vacuum housing 102 and is entirely within the free space 101. By placing all components of the suction apparatus 120 on a single axis 118 within a cylindrical geometry that is within the free space 101, criticality safety for this particular fissile unit is guaranteed. An advantage of this design is that it minimizes the cost and time required for engineering analyses to verify that the vacuum will remain sub-critical in its intended environment because inspectors can see that all components are positioned within the subcritical diameter discussed above.

The suction apparatus 120 includes a number of components that are sized and configured to operate together to safely provide the collection and separation characteristics required for a specific application. The components of the suction apparatus 120 may be constructed using metals or metal alloys, such as aluminum, stainless steel, or titanium; plastics, such as polylactic acid (PLA) or acrylonitrile butadiene styrene (ABS) plastic, or other types of suitable non-metals. The components may be constructed using a number of manufacturing methods, including 3-D printing methods, including direct metal laser sintering, and also injection molding, casting, or CNC machining.

Specifically, the suction apparatus 120 is configured to induce airflow through the intake port opening 116, through the internal housing chamber, and out of the top opening 110. The suction apparatus is further configured to separate solids or liquids that are entrained in the airflow, which may include fissile material, and to deposit those solids or liquids in a removable, user-supplied external storage container 103 that is mounted to the bottom opening 114 of the housing 102.

Figure 4:
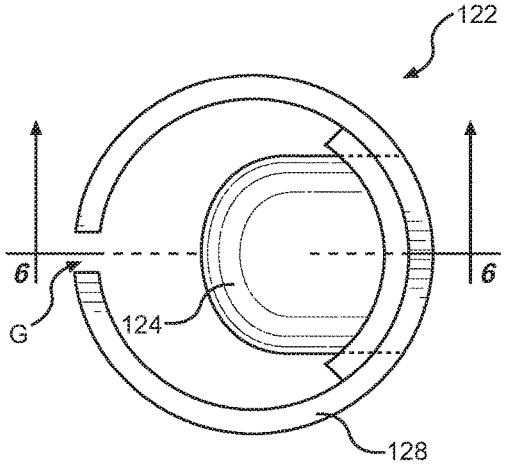
FIG. 4 is a top view of an intake.
Figure 5:
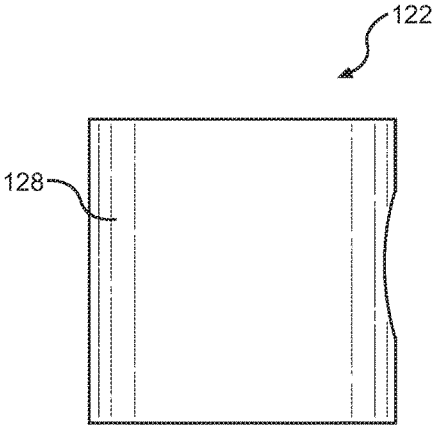
FIG. 5 is a side elevation view of an intake.
Figure 6:
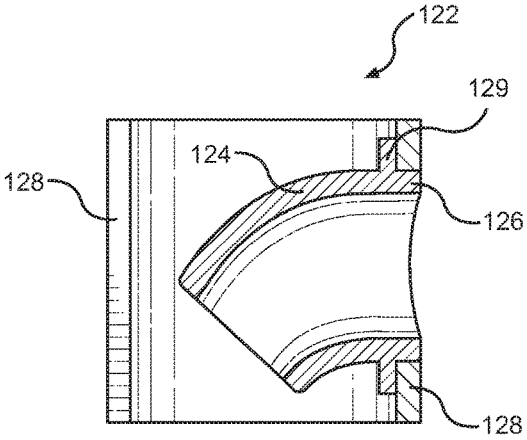
FIG. 6 is a section view along line 6-6 of FIG. 4, illustrating a section view of the intake.
Figure 7:
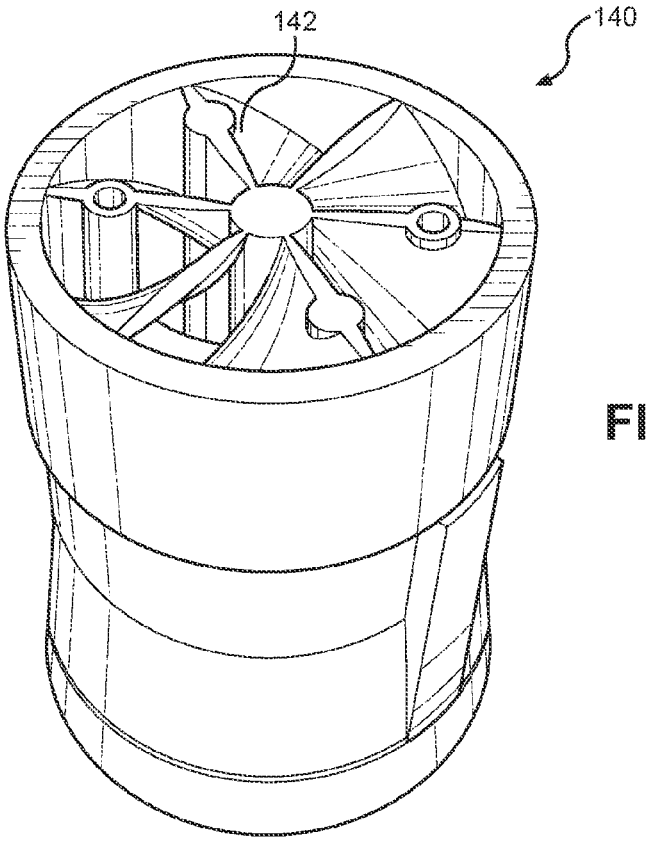
FIG. 7 is a perspective view illustrating a fan housing.
Figure 8:
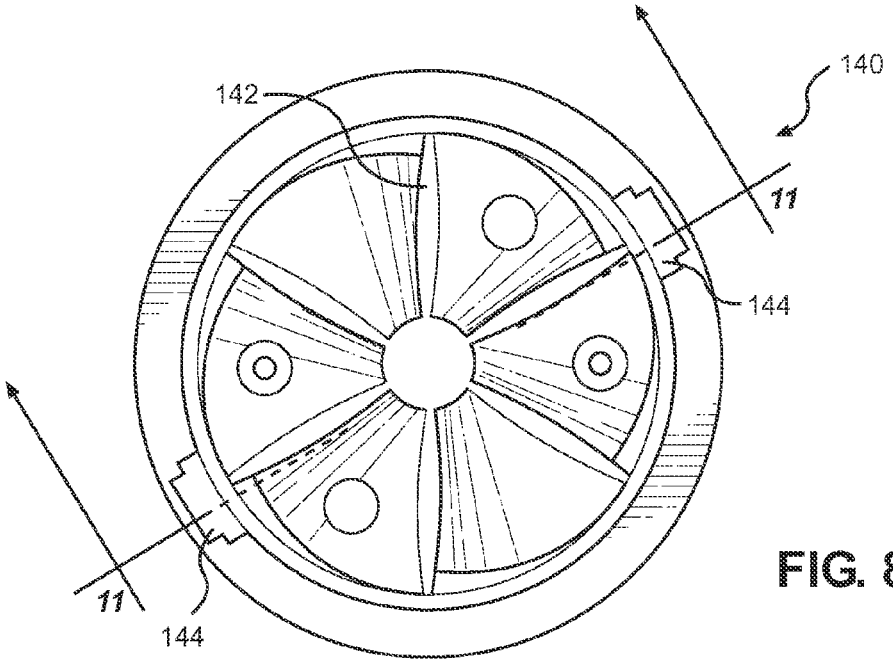
FIG. 8 is a bottom view of the fan housing of FIG. 7.
Figure 9:
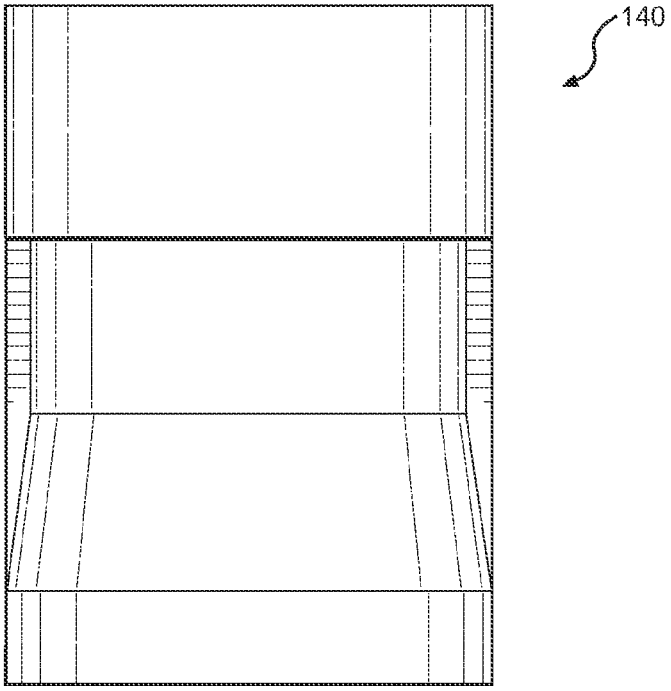
FIG. 9 is a side elevation view of the fan housing of FIG. 7.
Figure 10:
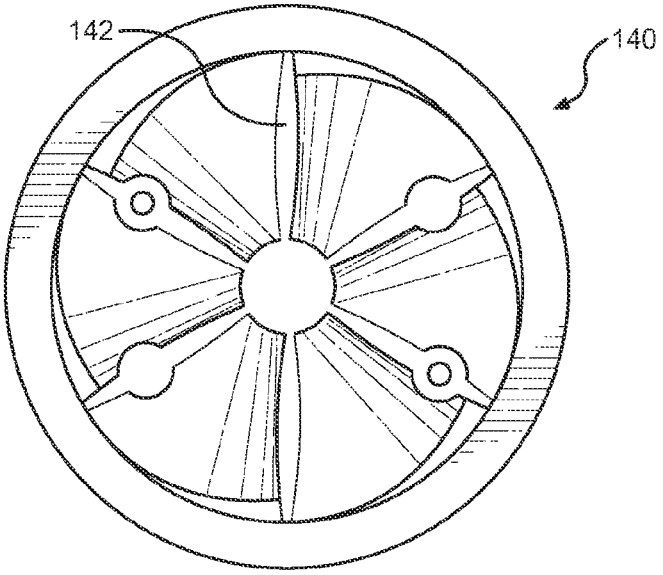
FIG. 10 is a top view of the fan housing of FIG. 7.

An intake 122 is positioned within the intake port opening 116 so that a portion of the intake extends into the housing 102 and a portion extends into the intake port opening 116. With reference to FIGS. 4-6, the intake 122 includes a cylindrically-shaped perimeter support ring 128, a flange 129 surrounding the intake port opening 116, a first extension portion 124 extends inwards from the flange 129, and a second extension portion 126 extends outwards from the flange 129 into the intake port opening 116. The intake 122 is installed by sliding it into the housing 102 and is located at the intake port opening 116. The intake 122 is positioned such that the first extension portion 124 extends from the intake port opening 116 into the internal housing chamber, and the second extension portion 126 extends into the intake port opening 116 and, in certain embodiments, is flush with the outer wall surface 104 of the housing 102.

The first extension portion 124 may be curved or may be straight. Preferably the first extension portion 124 is slightly curved towards the bottom end 112 and is configured to initially direct the airflow towards the bottom opening 114 of the vacuum housing 102 (FIG. 2). The downward curve directs the airflow towards the bottom opening 114 and the storage container 103 to provide an initial separation of at least the larger particulate matter from the airflow, which is deposited into the container.

The perimeter support ring 128 has an outer diameter and an inner diameter. The outer diameter of the perimeter support ring 128 is roughly equal to or slightly smaller than the inner diameter D2 of the housing. In this way the perimeter support ring 128 may be easily inserted into the housing 102. The perimeter support ring 128 is positioned against or in close proximity to the inner wall surface 106 of the housing. In certain embodiment, to further facilitate the insertion of the perimeter support ring 128 into the housing 102, the perimeter support ring 128 does not form a complete cylinder because there is a gap G provided in a portion the wall. The gap G enables the intake 122 to be partially collapsed during installation in order to reduce the outer diameter of the perimeter support ring 128, which allows the intake to more easily slide into position within the housing 102. The perimeter support ring 128 has sufficient thickness to enable other components to be stacked on top of the perimeter support ring 128 within the housing 102. During the installation of the intake 122, the perimeter support ring 128 provides a large region that can be mounted to the housing 102. To make the installation rigid, the intake is preferably riveted, cemented, or screwed into housing 102.

The intake 122 is preferably designed to enable off-the-shelf vacuum hose assemblies to be mounted to the housing 102. Therefore, the second extension portion 126 may extend out of the housing 102 and preferably provides hose connection means for mating with a vacuum hose assembly, including hoses and attachments. For example, the hose connection means may be a threaded connector for threadably connecting together with a hose assembly. In another example, the hose connection means is simply a cylindrical extension having a tip opening, wherein a hose may be inserted into the tip opening or may be placed around the cylindrical extension. Other similar devices such as latches, locks, etc. may also be used to mount a hose assembly to the second extension portion 126 of the intake 122.

As shown in FIG. 3, a collar 132 is located within the internal housing chamber beneath the intake 122. The collar 132 includes a perimeter support ring 134 that may be mounted to the inner wall surface 106 of the housing 102 and a connection member 136 for connecting to a removable storage container for collecting solids and liquids. In certain embodiments, the connection member 136 is a set of internal or external threads that is configured to connect with the container 103, such as a threaded plastic bottle such as a wide-mouth 2000 mL Nalgene® container, for collecting solids and liquids. Like the intake 122, the collar 132 is preferably riveted, cemented, or screwed into the housing 102.

With reference to FIGS. 3 and 7-12, the final component of this first embodiment of the suction apparatus 120 is a high-speed flow-through fan 138 and an optional fan housing 140 that is mounted to and covers the top portion of the fan. The fan 138 is configured to generate an airflow within the housing 102 that is generally parallel with the centerline axis 118, entering through the intake port opening 116 and exiting from the top opening 110. The fan housing 140 has a diffuser assembly 142 that is designed to minimize vacuum pressure drop and also to prevent an operator from accidentally being injured from contacting the blades and windings of the fan 138. The diffuser assembly includes a plurality of angled vents that are configured to direct the airflow out of the vacuum apparatus.

The fan 138 selected for this application should provide an effective flow rate and shutoff pressure rating and that will fit within the favorable geometry of the housing 102 described above. One suitable fan for certain embodiments of this invention is the Ametek Lamb fan (Part No. 116378-00). This fan and other similar fans will minimize the overall diameter while maintaining high flow rates and shutoff pressures required for effective collection of liquids and solids. The fan 138 may be powered by battery pack DC power, or alternatively by an externally mounted AC/DC power supply. In the present embodiment the fan 138 is an AC fan that could be operated by DC power using an inline DC/AC inverter. Fan configurations may be selected that are DC powered so that portable DC power packs may be used, or AC power might be used with an inline AC/DC converter.

During the manufacturing process, the fan 138 is inserted into the top opening 110 of the housing 102 and then the fan housing 140 is placed over the fan. In this particular embodiment, the bottom of the cylindrical fan housing 140 includes opposing square channels 144 that allow the top portion of the fan 138, including opposing motor brushes, to slide partially into the fan housing 140. This portion of the fan housing 140 is the largest portion of the entire apparatus 100, but, importantly, this portion is still within the free space 101, so that safe geometry is maintained. In other embodiments, a smaller fan and fan housing combination may chosen so that the largest diameter of the apparatus 100 is the outside diameter D1 of the housing 102.

Figure 11:
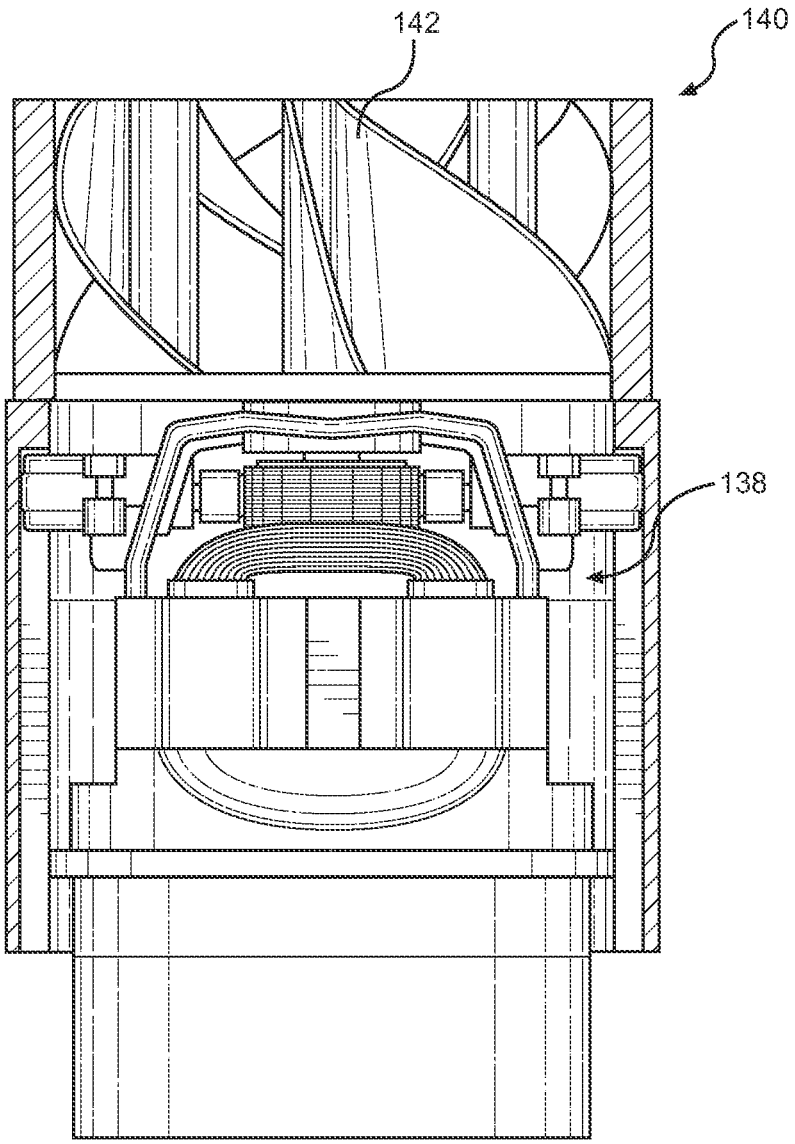
FIG. 11 is a section view along line 11-11 of FIG. 8, illustrating a section view of a fan inserted into the fan housing.

As shown in FIG. 11, after the top of the fan 138 is inserted into the fan housing 140, the bottom of the fan remains exposed and extends below the fan housing. This exposed bottom portion of the fan is inserted into the top opening 110 of the housing 102. Once inserted into the housing 102, the fan 138 and the fan housing 140 may be held in place by threading a connector or setscrew, such as an Allen set screw, into the housing. In certain embodiments, when the fan 138 and fan housing 140 are in their final position, the fan housing extends just to the very top of the housing 102. In other embodiments, however, a portion of the fan housing 140 extends partially around the top of the outer wall surface 104. In yet other embodiments, the fan housing 140 may be eliminated entirely and the fan 138 may be held in place by a retention ring. For example, a retention ring having a downwardly extending threaded lip may be placed over the fan 138 and threaded onto corresponding threads located on the top outer surface of the housing 102. The outer diameter of the retention ring is within the free space 101 to ensure safe geometry.

Having now discussed the primary components of a first embodiment of an apparatus 100 according to the present invention, a discussion of other optional features that might also be included in other embodiments will now be provided.

With reference now to FIGS. 3 and 19-22, certain embodiments of the apparatus 100 are provided with one or more lower baffles 146, which may be used to change the direction of the airflow within the housing 102 to more effectively remove entrained solids and liquids from the airflow. Each baffle 146 includes a cylindrical perimeter support ring 148 and a fin 150 that is located within the support ring. The fin 150 includes a bottom concave (i.e., bowing inward) surface 152 and a top convex (i.e., bowing outward) surface 154. The top surface 154 and the bottom surfaces 152 extend at least partially across the internal housing chamber and are joined together at a baffle centerline 156. When viewed from above (FIG. 19), the fin 150 appears roughly semicircular in shape when the baffle centerline 156 is located at the center of the internal housing chamber. The present embodiment includes a baffle centerline that extends halfway across the internal housing chamber. The baffles could also be configured to less than halfway across the internal housing chamber resulting in increased particulate flow above the baffles and decreased pressure drop in the baffle. The baffles could also be configured to extend beyond halfway across the internal housing chamber resulting in decreased particulate flow above the baffle and increased pressure drop in the baffle.

One primary function of the baffle 146 is to change the direction of the airflow as it travels upwards through the housing 102 and to facilitate the removal of solids and liquids from the airflow. In particular, the rounded bottom surface 152 changes the airflow path, providing radial velocity, which causes solids and liquids, entrained in the airflow, to be thrown against the inner wall of the baffle so that it can eventually fall within surface 106 of the housing toward the collection container 103, which tends to separate the solids and liquids from the airflow.

One or more baffles 146 may be stacked within the housing 102, including on top of one another, in order to provide additional filtering and separation of solids and liquids from the airflow. The baffles 146 are preferably mounted within the perimeter support ring 148, which allows baffles to be stacked on top of one another within the housing 102 and preferably abut to the top edge of the intake 122. As before, the outermost diameter of the perimeter support ring 148 is equal to or slightly less than the inner diameter D2 of the inner wall surface 106 to allow the baffles 146 to be easily inserted into the housing 102. When two or more baffles 146 are present, they may serve a radiological safety function and assist in preventing fissile material from exiting the device. In particular, as shown in FIG. 2, by placing a second baffle 146 above a first baffle such that the two baffle centerlines 156 are in vertical alignment but where the baffles themselves are located on opposite sides of the housing 102, the two baffles block both sides of the internal housing chamber. In other words, if the housing 102 having two opposing baffles 146 were viewed from the top (see FIG. 19), one semicircular baffle 146 would cover one half of the internal housing chamber and the second semicircular baffle would cover the second half of the internal housing chamber, so that there is no direct path out of the housing. This configuration, therefore, assists in preventing particulate matter from flowing directly from the intake 120 and out of the housing 102.

Referring now to FIGS. 2 and 3, additional filtering may be provided through the use of a filter 158, such as a HEPA filter. For example, in the embodiment shown, a cylindrical-type filter is used. The Filtrete Hoover® Twin Chamber 201 filter is one type of cylindrical filter that would be appropriate for this application. Canister-type filters typically have a ring of filter media and a sealed circular top and a circular bottom gasket having an opening to allow airflow into the filter. Airflow passes into the filter through the bottom opening and is then filtered as it passes laterally through the filter media. One or more puck-type filters could also be used in place of the cylindrical filter. A puck-type filter is also cylindrical in shape but is often shorter than the aforementioned cylindrical filter, so puck filters might be ideal for applications requiring a shorter overall height. In a puck filter, top and bottom openings are provided and the filter media is provided between these openings. Airflow enters the bottom of the filter, passes through the filter media, and exits via the top opening without a change in direction.

Figure 12:
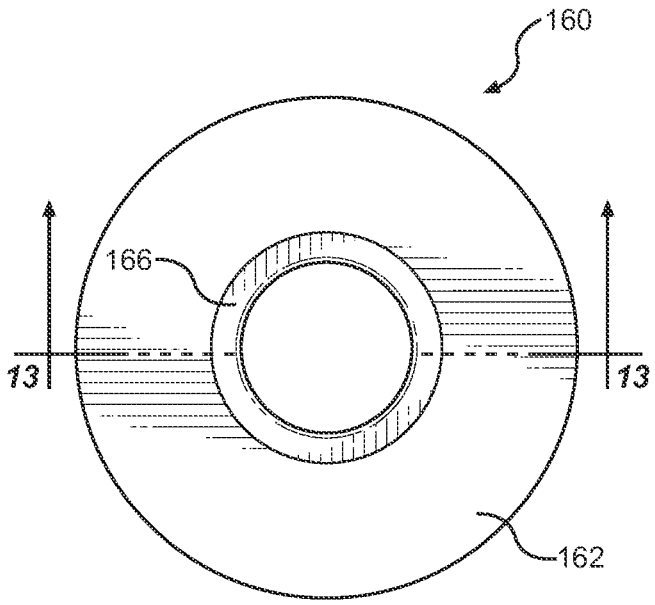
FIG. 12 is a top view of a filter cartridge support.
Figure 13:
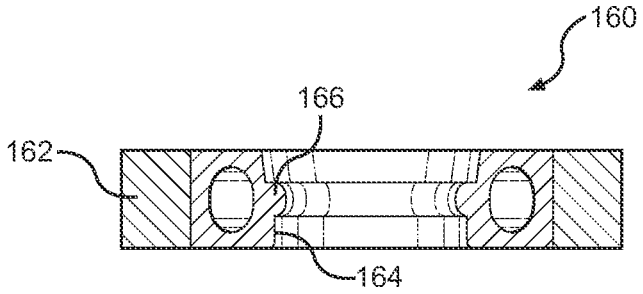
FIG. 13 is a section view along line 13-13 of FIG. 12, illustrating a section view of the filter cartridge support.
Figure 14:
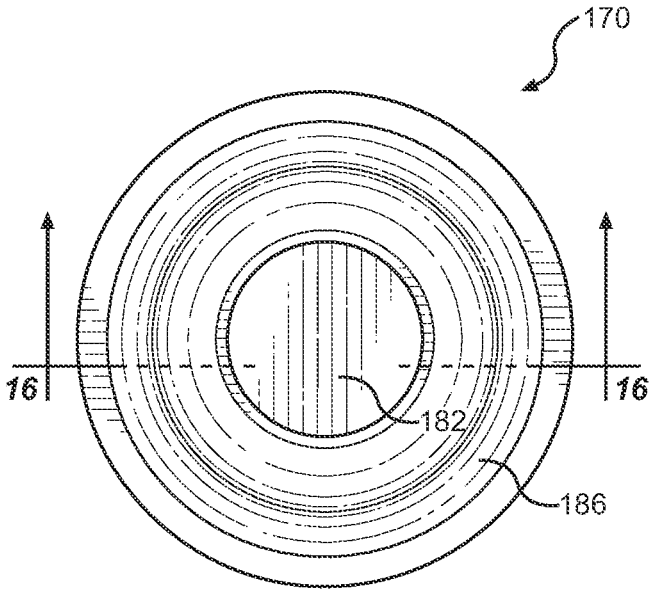
FIG. 14 is a top view illustrating an upper baffle.
Figure 15:
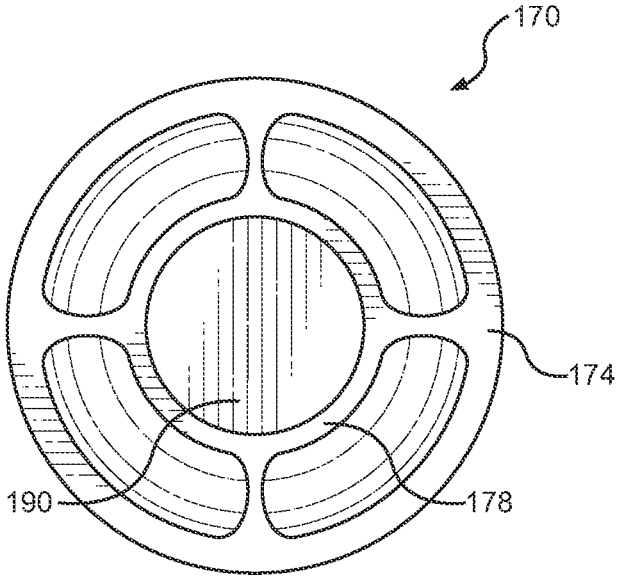
FIG. 15 is a bottom view of the upper baffle of FIG. 14.
Figure 16:
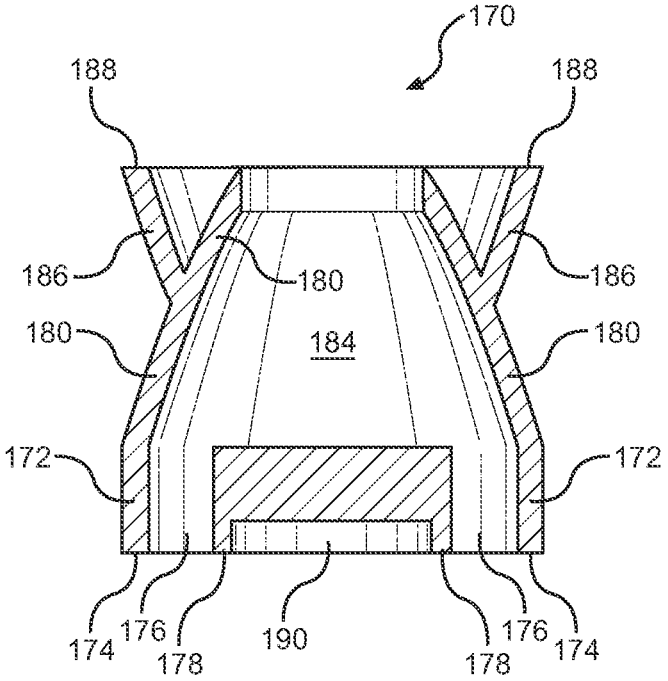
FIG. 16 is a section view along line 16-16 of FIG. 14, illustrating a section view of the upper baffle.
Figure 17:
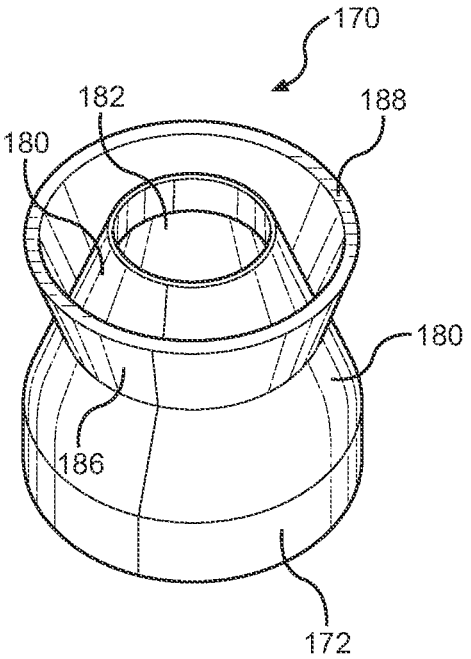
FIGS. 17 and 18 are upper and lower perspective view of the upper baffle of FIG. 14.
Figure 18:
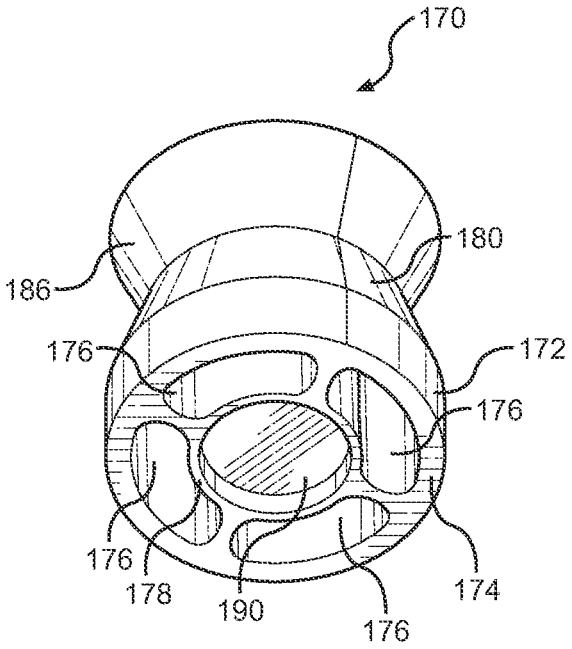
Figure 19:
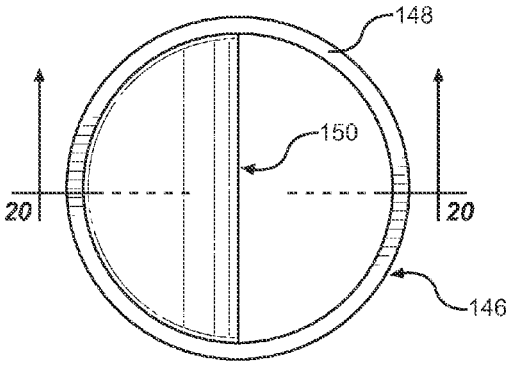
FIG. 19 is a top view of a lower baffle.
Figure 20:
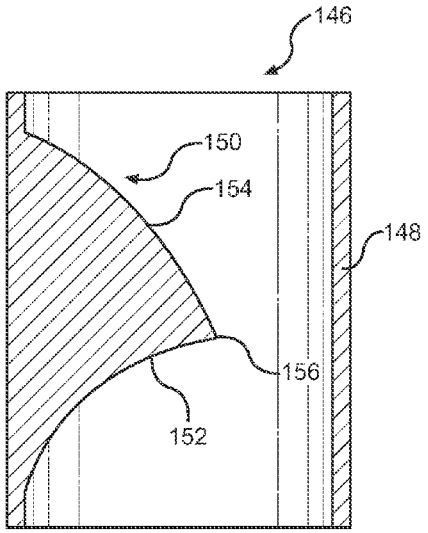
FIG. 20 is a section view along line 20-20 of FIG. 19, illustrating a section view of the lower baffle.
Figure 21:
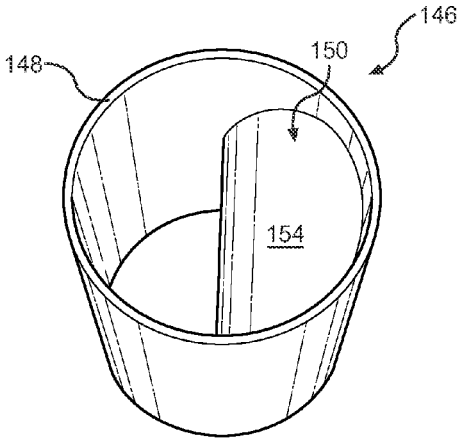
FIGS. 21 and 22 are upper and lower perspective view of the lower baffle of FIG. 19.
Figure 22:
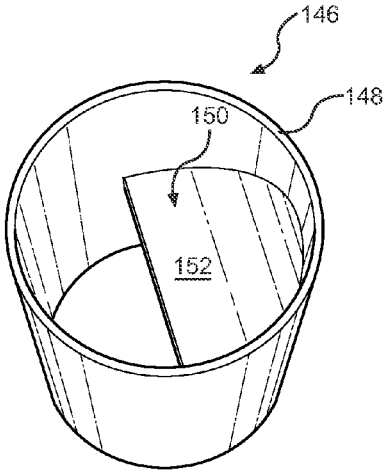

With continued reference to FIGS. 2 and 3 with further reference to FIGS. 12 and 13, the filter 158 may be secured within the housing 102 using a filter cartridge support 160. The filter cartridge support 160 includes a perimeter support ring 162 having an open center forming an inner wall 164. The perimeter support ring 162 is preferably riveted, cemented, or screwed into housing 102. In certain embodiments, the filter's lower gasket includes a channel and a flexible lower lip. To accommodate this type of filter design and to provide a very secure fit between the filter 158 and the filter cartridge support 160, the support may be provided with an annular seat 166 that extends away from the wall 164. The flexible lower lip slides past the annular seat 166 so that portion of the gasket contacts the top of the annular seat and a portion of the gasket contacts the bottom of the annular seat. A more preferable embodiment, however, is to simply provide a filter cartridge support 160 having an inner wall 164 that is substantially flat.

With reference to FIGS. 2, 3 and 14-18, at least one upper baffle 170 may be provided to direct airflow exiting the filter into the fan. The upper baffle 170 has a lower sidewall portion 172 having a bottom surface 174. In this particular embodiment, looking from the bottom towards the bottom surface, the lower sidewall portion 172 is circular in shape and has a diameter that is equal to or slightly less than the inner diameter D2 of the inner wall surface 106. In this way a snug fit is provided between the sidewall portion 172 and the inner wall surface 106 of the housing 102. One or more airflow openings 176 are distributed around a central bottom surface 178.

In certain embodiments, the central bottom surface has a seat 190 that receives and supports the top of the filter 158. The apparatus 100 is sized so that the fan 138 and fan housing 140 cannot be correctly positioned if the filter 158 is not properly seated at the top and at the bottom in the filter cartridge support 160 and upper baffle 170, respectively. This is design feature is a safety check that ensures that the filter 158 forms a complete seal and that there are no gaps, which would allow unfiltered air to potentially exit the housing 102. For example, if the filter 158 were cocked in its placement in the apparatus 100, gaps might form at the top and bottom of the filter and fissile material could flow through one of those gaps. However, this is avoided by having an apparatus 100, as described above, which cannot be placed into an operational state unless the filter 158 is properly seated.

Moving up the upper baffle 170, the lower sidewall 172 transitions and becomes angled, forming an angled middle sidewall 180 that is shaped like a cone where the tip of the cone has been removed, thereby forming a single top opening 182. The cone shape may be configured as a triangular cone or a curve parabolic cone as in the current embodiment to help minimize pressure drops in the device. A hollow space 184 is formed within the middle sidewall 172, which is in flow communication with the airflow openings 176. An angled upper sidewall 186 extends away from the middle sidewall 180 and terminates at a flat perimeter support ring 188. The perimeter support ring 188 preferably has an outer diameter that is equal to or slightly less than the inner diameter D2 of the inner wall surface 106 of the housing 102. Preferably, in operation, the perimeter support ring 188 contacts the inner wall surface 106 of the housing 102 to provide support for the upper baffle 170 and to reduce movement and vibration. Also, the flat top surface of the perimeter support ring 180 provides a surface for stacking additional internal components onto the upper baffle.

As shown in FIG. 2, the upper baffle 170 may be used to redirect the airflow and may be used in connection with the previously discussed lower baffles 146 and filter 158, or without lower baffles or filter. If a cylinder type filter 158 is provided, the airflow exits the filter laterally through the filter media. It then continues traveling upwards through the housing 102 and enters the upper baffle 170 through the one or more airflow openings 176. The individual airflow streams are then combined in the hollow space 184 in a funneling type movement and then exits the upper baffle 170 through the single top opening 182. The cone-shaped hollow space 184 redirects the airflow and gently forms it into a single stream, which is then directed into the fan 138. The upper baffle 170 would work in a similar manner if alternative filters were used in place of a cylinder-type filter.

One major advantage of forming a single stream of airflow in this manner is that it reduces the amount of vacuum pressure loss that would be present if the upper baffle 170 were not present and the airflow were permitted to simply flow, unguided into the bottom of the fan 138. Additionally, forming a single airflow stream in this manner prevents the formation of eddy currents within the housing, which would also reduce the vacuum pressure. Maintaining an effective level of vacuum pressure is important for ensuring that all fissile material is captured in the airflow.

In certain embodiments, the apparatus further includes an internal iris valve, butterfly valve or other similar internal closure, which is used to isolate the housing 102 from the storage container 103. This isolation can help to minimize the potential spread of radiological contaminants. In particular, the internal closure may be closed when the external collection container 103 is being removed from the bottom of the apparatus 100 and replaced in order to isolate the vacuum interior.

Preferably, the vacuum apparatus 100 has a modular design, so that each device may easily be customized for a customer's specific needs. Each component is preferably sized to have an external size that is smaller than the inner diameter D2 and a shape that corresponds with the shape of the inner wall surface 106 of the vacuum housing 102. The location of the intake port opening 116 is fixed within the housing 102, but all of the components between the intake port opening and the top opening 110 can be varied due to the modular design in order to allow for easy adjustment of the internal configuration. For example, a standard vacuum model might be provided with one baffle and a particular HEPA filter, but a particular customer might require additional baffles and a different HEPA filter for their particular application. Due to the modular design, the standard vacuum design can easily be customized to meet the customer's specific needs.

Figure 23:
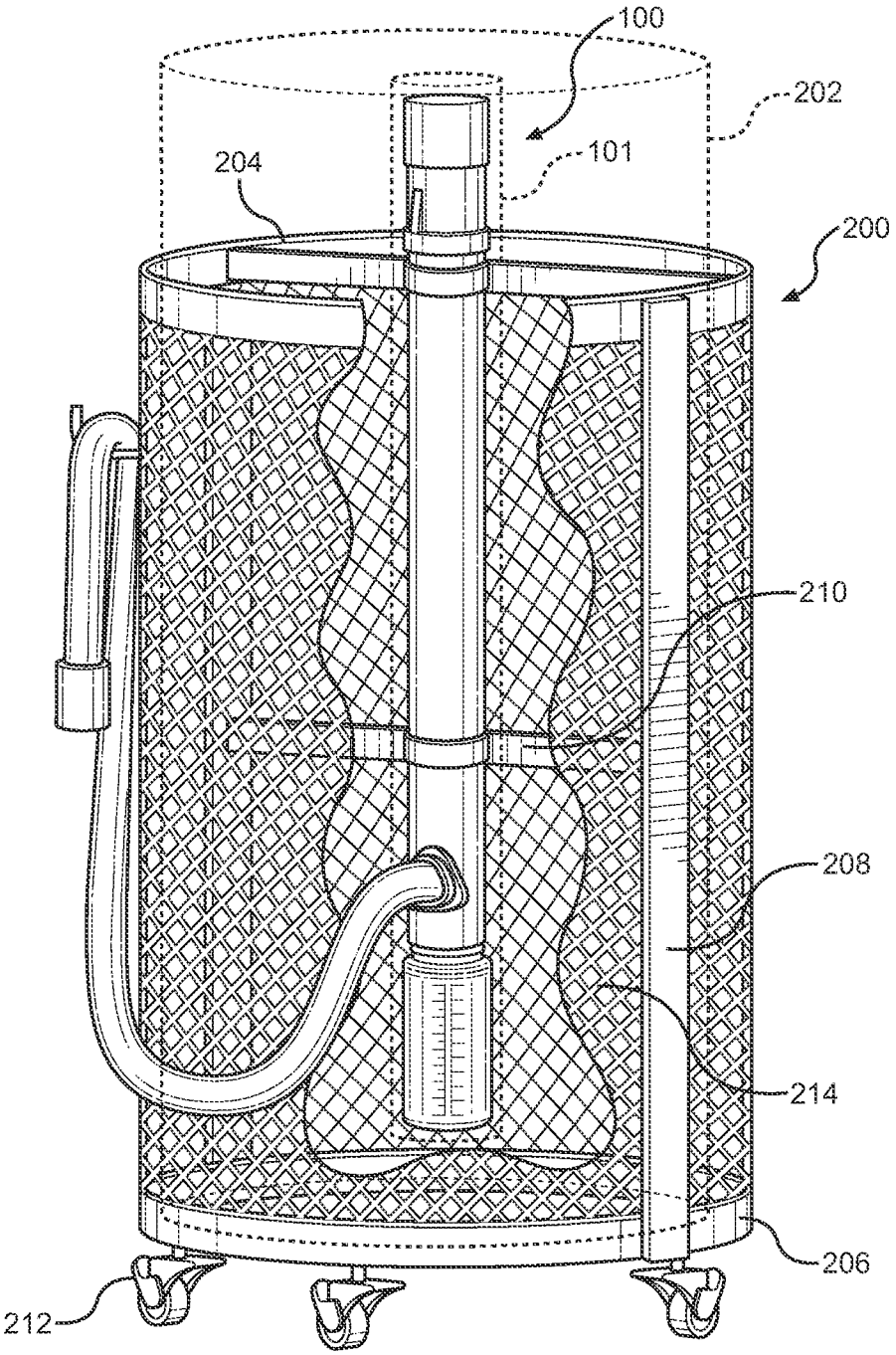
FIG. 23 illustrates a vacuum cleaner of the present invention including a spacer device having rolling members and a hose assembly attached.

As mentioned previously, even a fissile unit having a safe geometrical shape, such as the vacuum apparatus 100 described above, can become unsafe if it is permitted to unsafely interact with another fissile unit. For this reason, as shown in FIG. 23, the vacuum apparatus 100 may be mounted within a spacer device 200 for providing passive spacing from other potential sources of fissile material in order to provide interaction control to prevent nuclear criticality accidents. The spacer device 200 includes an outer cage that prevents other objects from getting within a specified distance to the vacuum apparatus 100. That specified distance, outside of a second cylindrical free space 202 surrounding the vacuum 100, is dependent on a number of criticality parameters but is sufficient to prevent unsafe interactions between fissile units in a given environment. The distance required to provide spacing control is established by practices and analyses established at each customer's facility; although minimum 12 inch spacing from the vacuum apparatus 100 to the second cylindrical free space 202 will meet most customer needs.

In this particular embodiment, the cage 200 includes upper and lower rings 204, 206, each having a diameter that is sized to prevent unsafe interactions between fissile units in a given environment. The rings 204, 206 are connected by a plurality of upright support members 208. One or more lateral support member(s) 210 is connected between opposing sides of the cage 200, preferably between two lateral support members 210, and is also mounted to the vacuum apparatus 100 to correctly position the vacuum within the cage along a common axis centerline 118 to the vacuum apparatus 100 and the cage 200 and to assist in preventing the vacuum from moving within the cage during use or transport. In other embodiments, the wall may comprise a single wall that forms a perimeter located outside of the second cylindrical free space 202 and that encircles the vacuum apparatus 100. A plurality of casters 212 may also be provided to allow for easy transport of the cage 202. The outside of the cage 202 may also be covered to prevent ready access to the vacuum 100. For example, a screen 214 may be mounted to upright support members 208, or the cage may be assembled from tightly spaced vertical bars that effectively form a perimeter boundary that extends between the upper and lower rings 204, 206.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A vacuum cleaner apparatus for fissile material comprising:

a single unit elongate vacuum cleaner assembled along a centerline axis and configured for the separation and recovery of a fissile material entrained in an airflow, the vacuum cleaner having:

a housing having an outer wall having an outer wall surface and an inner wall surface defining an internal housing chamber, the housing also including a top end having a top opening, a bottom end having a bottom opening, and a radial intake port opening disposed in the outer wall proximate the bottom end;

a suction apparatus having:

an intake disposed at the intake port opening and having a hose connection means for mating with a vacuum hose assembly;

a flow-through fan disposed in the top opening of the housing and having an intake and an exhaust, the flow-through fan configured to intake and exhaust the airflow in a direction parallel with the centerline axis;

container connection means disposed at the bottom opening for connecting an external container to bottom end of the housing; and a first cylindrical free space having a center point disposed along the centerline axis and a diameter passing through the center point, wherein the vacuum cleaner apparatus is sized to fit entirely within the diameter of the first free space, and wherein the diameter of the first cylindrical free space is less than or equal to maximum sub-critical diameter of a cylinder of the fissile material.

2. The apparatus of claim 1 further comprising a first baffle having a bottom surface and a top surface joined at a baffle centerline, wherein the first baffle is sized and configured to obstruct a first half of an airflow path through the internal housing chamber and wherein the bottom surface is configured to redirect the airflow in a first direction towards the inner wall surface.

3. The apparatus of claim 2 further comprising a second baffle having a bottom surface and a top surface joined at a baffle centerline, wherein the second baffle is sized and configured to obstruct a second half of the airflow path through the internal housing chamber such that the first and second baffles, in combination, obstruct both halves of the airflow path when viewed along the centerline axis and wherein the bottom surface is configured to redirect the airflow in a second direction towards the inner wall surface.

4. The apparatus of claim 1 further comprising a third baffle configured to direct the airflow to the intake of the fan through a funnel action, the third baffle having:

a lower sidewall portion having a bottom surface and one or more bottom airflow openings disposed in the bottom surface that extend through the lower portion;

a middle sidewall forming a cone region having a top opening and a hollow interior in flow communication with the one or more bottom airflow openings; and an upper sidewall extending away from an external surface of the middle sidewall, a portion of the upper sidewall configured to contact the inner wall surface of the housing.

5. The apparatus of claim 1 further comprising:

a fixed first filter support mounted within the internal housing chamber and configured to support a bottom portion of a filter; and a removable second filter support configured to support a top portion of a filter.

6. The apparatus of claim 5 further comprising a third baffle configured to direct the airflow to the intake of the fan through a funnel action, the third baffle having:

a lower sidewall portion having a bottom surface and one or more bottom airflow openings disposed in the bottom surface that extend through the lower portion;

a middle sidewall forming a cone region having a top opening and a hollow interior in flow communication with the one or more bottom airflow openings; and an upper sidewall extending away from an external surface of the middle sidewall, a portion of the upper sidewall configured to contact the inner wall surface of the housing;

wherein the removable second filter support includes a seat disposed in the bottom surface of the lower sidewall.

7. The apparatus of claim 5 wherein the vacuum cleaner is configured so that it may not be placed into an operational state when the bottom of the filter is not properly seated within the first filter support or the top of the filter is not properly seated within the second filter support.

8. The apparatus of claim 1 further comprising a fan housing configured to mount to the fan and having a diffuser assembly comprising a plurality of stationary angled vents that are arranged to cover at least a portion of the exhaust of the fan.

9. The apparatus of claim 1 wherein the vacuum cleaner is configured for the separation of solids or liquids.

10. The apparatus of claim 1 wherein the intake includes:

a flange disposed on the inside of the housing chamber surrounding the intake port opening;

a first extension portion extending from the flange into the internal housing chamber that is configured to direct the airflow towards the bottom end of the vacuum housing; and a second extension portion extending from the flange outwards into the intake port opening, the second extension portion having a hose connection means for mating with a vacuum hose assembly.

11. The apparatus of claim 1 wherein the suction apparatus is at least partially removable from the housing.

12. The apparatus of claim 1 further comprising a spacer having:

a cage having an outer contact surface; and a second cylindrical free space having a center point disposed along the centerline axis and a diameter passing through the center point, wherein the diameter is greater than or equal to the minimum safe distance between the vacuum cleaner and a second fissile unit external to the vacuum apparatus required to prevent a criticality from occurring between the vacuum and the second fissile unit; and wherein the outer contact surface is located entirely outside of the second cylindrical free space.

13. The apparatus of claim 12 wherein the cage includes:

upper and lower spacing members disposed around the vacuum and spaced apart from one another;

at least one first support member configured to connect the upper and lower spacing members together;

a second support member configured to connect the at least one first support member and the vacuum together.

14. The apparatus of claim 12 further comprising a plurality of rolling members disposed on a bottom surface of the cage to facilitate transport of the cage.

15. The apparatus of claim 1 wherein the suction apparatus is removable from the housing.

16. A vacuum cleaner apparatus comprising:

a single unit elongate vacuum cleaner assembled along a centerline axis and configured for the separation and recovery of a fissile material entrained in an airflow, the vacuum cleaner having:

a housing having an outer wall having an outer wall surface and an inner wall surface defining an internal housing chamber, the housing also including a top end having a top opening, a bottom end having a bottom opening, and a radial intake port opening disposed in the outer wall proximate the bottom end;

a removable suction apparatus having:

an intake disposed in the intake port opening, the intake having: a flange disposed on the inside of the housing chamber surrounding the intake port opening; a first extension portion extending from the flange into the internal housing chamber and configured to direct the airflow towards the bottom end of the vacuum housing; and a second extension portion extending from the flange outwards into the intake port opening, the second extension portion having a hose connection means for mating with a vacuum hose assembly;

a flow-through fan mounted proximate the top opening and having an intake opening and an exhaust opening, the fan being configured to intake and exhaust the airflow in a direction parallel with the centerline axis;

a fan housing configured to mount to the fan and having a diffuser assembly comprising a plurality of stationary angled vents that are arranged to cover at least a portion of the exhaust opening of the fan;

a fixed first filter support mounted within the internal housing chamber and configured to support a bottom portion of a filter; and a removable second filter support configured to support a top portion of a filter;

a first baffle having a bottom surface and a top surface joined at a baffle centerline, wherein the first baffle is sized and configured to obstruct a first half of an airflow path through the internal housing chamber and wherein the bottom surface is configured to redirect the airflow in a first direction towards the inner wall surface;

a second baffle having a bottom surface and a top surface joined at a baffle centerline, wherein the second baffle is sized and configured to obstruct a second half of an airflow path through the internal housing chamber and wherein the bottom surface is configured to redirect the airflow in a second direction towards the inner wall surface;

a third baffle configured to direct the airflow to the intake of the fan through a funnel action, the third baffle having:

a lower sidewall portion having a bottom surface and one or more bottom airflow openings disposed in the bottom surface that extend through the lower portion;

a middle sidewall forming a cone region having a top opening and a hollow interior in flow communication with the one or more bottom airflow openings; and an upper sidewall extending away from an external surface of the middle sidewall, a portion of the upper sidewall configured to contact the inner wall surface of the housing;

connection means disposed proximate the bottom opening for connecting an external container to bottom end of the vacuum housing;

a first cylindrical free space having a diameter that passes through the centerline axis, wherein the vacuum cleaner apparatus is sized to fit entirely within the diameter of the free space and wherein the diameter of the first cylindrical free space is the maximum subcritical diameter of a cylinder of the fissile material.

17. The apparatus of claim 16 further comprising a spacer having:

a cage having an outer contact surface; and a second cylindrical free space having a center point disposed along the centerline axis and a diameter passing through the center point, wherein the diameter is the minimum safe distance between the vacuum cleaner and a second fissile unit external to the vacuum required to prevent a criticality from occurring between the vacuum and the second fissile unit; and wherein the outer contact surface is located entirely outside of the second cylindrical free space.

18. The apparatus of claim 17 wherein the cage includes:

upper and lower spacing members disposed around the vacuum and spaced apart from one another;

at least one first support member configured to connect the upper and lower spacing members together;

a second support member configured to connect the at least one first support member and the vacuum together.

* * * * *